US008696889B2

(12) United States Patent
Bielenberg et al.

(10) Patent No.: US 8,696,889 B2
(45) **Date of Patent: *Apr. 15, 2014**

(54) DESULFURIZATION OF HEAVY HYDROCARBONS AND CONVERSION OF RESULTING HYDROSULFIDES UTILIZING A TRANSITION METAL OXIDE

(75) Inventors: James R. Bielenberg, Easton, PA (US); Jonathan M. McConnachie, Annadale, NJ (US); Daniel P. Leta, Flemington, NJ (US); Chris A. Wright, Bordentown, NJ (US); Leo D. Brown, Baton Rouge, LA (US)

(73) Assignee: ExxonMobil Research and Engineering Company, Annadale, NJ (US)

( * ) Notice: Subject to any disclaimer, the term of this patent is extended or adjusted under 35 U.S.C. 154(b) by 591 days.

This patent is subject to a terminal disclaimer.

(21) Appl. No.: 12/586,824

(22) Filed: Sep. 29, 2009

(65) Prior Publication Data

US 2010/0084316 A1 Apr. 8, 2010

Related U.S. Application Data

(60) Provisional application No. 61/194,946, filed on Oct. 2, 2008.

(51) Int. Cl.
*C10G 19/08* (2006.01)
*C10G 19/02* (2006.01)
*C10G 19/00* (2006.01)

(52) U.S. Cl.
USPC ..... 208/235; 208/177; 208/208 R; 208/226; 208/230

(58) Field of Classification Search
USPC ..... 208/203, 213, 216 R, 217, 220, 243, 208/249, 177, 208 R, 226, 230, 235
See application file for complete search history.

(56) References Cited

U.S. PATENT DOCUMENTS 458,563 A 9/1891 Ellershausen
2,054,727 A 9/1936 Lundin et al.
(Continued)

FOREIGN PATENT DOCUMENTS

EP 0 121 343 A1 10/1984
GB 745633 2/1956
(Continued)

OTHER PUBLICATIONS

R.I. Razouk, et al., The Roasting of Precipitated Copper Sulphide, Journal of Applied Chemistiry, Apr. 1962, vol. 12, Issue 4, pp. 194-195.*

(Continued)

*Primary Examiner* — Walter D Griffin
*Assistant Examiner* — Derek Mueller
(74) *Attorney, Agent, or Firm* — Bruce M. Bordelon; Chad A. Guice

(57) ABSTRACT

The present invention is a process for desulfurizing hydrocarbon feedstreams with alkali metal compounds and regenerating the alkali metal compounds via the use of a transition metal oxide. The present invention employs the use of a transition metal oxide, preferably copper oxide, in order to convert spent alkali metal hydrosulfides in the regeneration of the alkali hydroxide compounds for reutilization in the desulfurization process for the hydrocarbon feedstreams. Additionally, in preferred embodiments of the processes disclosed herein, carbonates which may be detrimental to the overall desulfurization process and related equipment are removed from the regenerated alkali metal stream.

22 Claims, 2 Drawing Sheets

(56) References Cited

U.S. PATENT DOCUMENTS

| | | | | |
|---|---|---|---|---|
| 2,164,141 | A | 6/1939 | Moore | |
| 2,267,809 | A | 11/1939 | Border | |
| 2,211,695 | A | 8/1940 | Hughes | |
| 2,696,475 | A * | 12/1954 | Farrow | 502/335 |
| 2,783,184 | A | 2/1957 | Miller | |
| 3,454,488 | A | 7/1969 | Lewis et al. | |
| 4,003,823 | A | 1/1977 | Baird, Jr. et al. | |
| 4,087,349 | A | 5/1978 | Baird, Jr. | |
| 4,119,528 | A | 10/1978 | Baird, Jr. et al. | |
| 4,127,470 | A | 11/1978 | Baird, Jr. et al. | |
| 4,147,611 | A | 4/1979 | Miasek et al. | |
| 4,147,612 | A | 4/1979 | Miasek et al. | |
| 4,163,043 | A | 7/1979 | Dezael et al. | |
| 4,420,464 | A | 12/1983 | Barclay | |
| 4,437,980 | A | 3/1984 | Heredy et al. | |
| 4,491,513 | A | 1/1985 | Siskin et al. | |
| 4,981,556 | A | 1/1991 | Hedblom et al. | |
| 5,409,600 | A | 4/1995 | Weissman et al. | |
| 5,508,018 | A | 4/1996 | Brons et al. | |
| 5,626,742 | A | 5/1997 | Brons et al. | |
| 5,695,632 | A | 12/1997 | Brons et al. | |
| 6,268,543 | B1 | 7/2001 | Sakai et al. | |
| 6,806,398 | B2 | 10/2004 | Sakai et al. | |
| 7,198,712 | B2 | 4/2007 | Olivier-Bourbigou et al. | |
| 2004/0167013 | A1 | 8/2004 | Ou et al. | |
| 2005/0121363 | A1 | 6/2005 | Vierheilig et al. | |
| 2005/0258070 | A1 | 11/2005 | Varadaraj et al. | |
| 2006/0100096 | A1 | 5/2006 | Liu et al. | |
| 2007/0114155 | A1 | 5/2007 | Cholley et al. | |

FOREIGN PATENT DOCUMENTS

| | | | |
|---|---|---|---|
| GB | 759305 | | 10/1956 |
| GB | 767592 | | 2/1957 |
| GB | 946950 | | 1/1964 |
| GB | 1133695 | | 11/1968 |
| WO | WO 2007/078416 | A1 | 7/2007 |
| WO | WO 2007/103440 | A2 | 9/2007 |

OTHER PUBLICATIONS

Rayner-Canham, Descriptive Inorganic Chemistry, 1999, W.H. Freeman & Co., 2d. Ed., p. 215.*

Mohan S. Rana, Vicente Samano, Jorge Ancheyta, J. A. I. Diaz; "A Review of Recent Advances on Process Technologies for Upgrading of Heavy Oils and Residua," Fuel, vol. 86, Issue 9, Jun. 2007, pp. 1216-1231. Abstract.

A. Kishita, S. Takahashi, Y. Yamasaki, F. M. Jin, T. Moriya, H. Enomoto; "Desulfurization of Bitumen by Hydrothermal Upgrading Process in Supercritical Water with Alkali," Journal of the Japan Petroleum Institute, 2006, vol. 49, No. 4 (Jul.) pp. 177-185. Abstract.

C.-H. Yang, et al.; "Studies on the Coke Property and Distribution onthe Catalyst for Residua Hydroconversion," American Chemical Society, Division of Petroleum Chemistry, 2002, 47 (3), 31-320 [Fuel and Energy Abstracts, vol. 44, Issue 4, Jul. 2003, p. 209] No Abstract.

F. Alonso, I. P. Beletskaya, M. Yus; "Metal-mediated reductive hydrodehalogenation of organic halides," Chemical Reviews, vol. 102, Issue 11, Nov. 2002, pp. 4009-4091. Abstract.

"The Transition to Ultra-Low-Sulfur Diesel Fuel: Effects on Prices and Supply," Energy Information Administration, Office of Integrated Analysis and Forecasting, U.S. Dept. Of Energy, Washington, DC 20585, May 2001. Abstract.

A. M. Aitani, M. F. Ali, H. H. Al-Ali; "A Review of Non-Conventional Methods for the Desulfurization of Residual Fuel Oil," Petroleum Science and Technology, 2000, vol. 18, No. 5-6, pp. 537-553. Abstract.

M. R. Antonio, G. B. Karet, J. P. Guzowski; "Iron Chemistry in Petroleum Production," Fuell, 2000, vol. 79, No. 1 (Jan.) pp. 37-45. Abstract.

Ram Ramachandran, Raghu K. Menon; "An Overview of Industrial Uses of Hydrogen," International Journal of Hydrogen Energy, vol. 23, Issue 7, Jul. 1998, pp. 593-598. Abstract.

Ajoy P. Raje, Shun-Jeng Liaw, Burtron H. Davis; "Second Row Transition Metal Fulfides for the Hydrotreatment of Coal-Derived Naphtha II. Removal of Individual Sulfur Compounds," Applied Catalysis A: General, vol. 150, Issue 2, Mar. 13, 1997, pp. 319-342. Abstract.

P. Le Perchec, B. Fixari, M. Vrinta, F. Morel; "Hydroconversion of Heavy Oil Residues with Sulfided Additives or Catalysts," JAmerican Chemical Society, Division of Petroleum Chemistry, Preprints, vol. 40, Issue 4, Aug. 1995, pp. 747-751. Abstract.

"Profile of the Petroleum Refining Industry," EPA Office of Compliance Sector Notebook EPA/310-R-95-013, Sep. 1995. Abstract.

Alberto Del Bianco, Nicoletta Panariti, Sabatino Di Carlo, Jeanne Elmouchnino, Bernard Fixari, Pierre Le Perchec, "Thermocatalytic Hydroconversion of Heavy Petroleum Cuts with Dispersed Catalyst," Applied Catalysis A: General, vol. 94, Issue 1, Jan. 1993, pp. 1-16. Abstract.

J. M. Oelderik, S. T. Sie, D. Bode; "Progress in the Catalysis of the Upgrading of Petroleum Residue: A Review of 255 Years of R&D on Shell's Residue Hydroconversion Technology," Applied Catalysis, vol. 47, Issue 1, Feb. 1989, pp. 1-24. Abstract.

William L. Bider, Robert G. Hunt, Francline Assotiotes, Ltd.; "Industrial Recourse Recovery Practices: Petroleum Refineries and Related Industries," Prepared for U.S. Environmental Protection Agency, Office of Solid Waste, Washington, D.C., Jun. 15, 1982. Abstract.

D. P. N. Satchell; "Metal-Ion-Promoted Reactions of Organo-Sulphur Compounds," Chem. Soc. Rev., 1997, 6, pp. 345-371. No Abstract.

John R. Wasson, Gerald M. Woltermann, Henry J. Stoklosa; "Transition Metal Dithio-and Diselenophosphate Complexes,"Topics in Current Chemistry Chemistry and Materials Science), vol. 35, 1973. Abstract.

* cited by examiner

DESULFURIZATION OF HEAVY HYDROCARBONS AND CONVERSION OF RESULTING HYDROSULFIDES UTILIZING A TRANSITION METAL OXIDE

This application claims the benefit of U.S. Provisional Application No. 61/194,946 filed Oct. 2, 2008.

FIELD OF THE INVENTION

The present invention relates to a process for desulfurizing hydrocarbon feedstreams with alkali metal compounds and regenerating the alkali metal compounds via the use of a transition metal oxide. The present invention employs the use of a transition metal oxide, preferably copper oxide, in order to convert spent alkali metal hydrosulfides in the regeneration of the alkali hydroxide compounds for reutilization in the desulfurization process for the hydrocarbon feedtreams. Additionally, in preferred embodiments of the processes disclosed herein, carbonates which form as byproducts of the desulfurization process, and are non-regenerable with copper oxide, are removed from the regenerated alkali hydroxide stream.

DESCRIPTION OF RELATED ART

As the demand for hydrocarbon-based fuels has increased, the need for improved processes for desulfurizing hydrocarbon feedstocks has increased as well as the need for increasing the conversion of the heavy portions of these feedstocks into more valuable, lighter fuel products. These hydrocarbon feedstocks include, but are not limited to, whole and reduced petroleum crudes, shale oils, coal liquids, atmospheric and vacuum residua, asphaltenes, deasphalted oils, cycle oils, FCC tower bottoms, gas oils, including atmospheric and vacuum gas oils and coker gas oils, light to heavy distillates including raw virgin distillates, hydrocrackates, hydrotreated oils, dewaxed oils, slack waxes, raffinates, and mixtures thereof. Hydrocarbon streams boiling above 430° F. (220° C.) often contain a considerable amount of large multi-ring hydrocarbon molecules and/or a conglomerated association of large molecules containing a large portion of the sulfur, nitrogen and metals present in the hydrocarbon stream. A significant portion of the sulfur contained in these heavy oils is in the form of heteroatoms in polycyclic aromatic molecules, comprised of sulfur compounds such as dibenzothiophenes, from which the sulfur is difficult to remove.

The high molecular weight, large multi-ring aromatic hydrocarbon molecules or associated heteroatom-containing (e.g., S, N, O) multi-ring hydrocarbon molecules in heavy oils are generally found in a solubility class of molecules termed as asphaltenes. A significant portion of the sulfur is contained within the structure of these asphaltenes or lower molecular weight polar molecules termed as "polars" or "resins". Due to the large aromatic structures of the asphaltenes, the contained sulfur can be refractory in nature and can be difficult to remove by conventional alkali salt extraction processes utilizing sodium hydroxide or potassium hydroxide solution treatments under conventional operating conditions. Other related technologies for desulfurization, such as hydrodesulfurization of petroleum oils are well known in the industry. However, when applied to heavy oils, these hydrodesulfurization processes generally operate at pressures above about 1500 psi, at high hydrogen partial pressures (generally above about 1200 psi), and in the presence of hydrogenation metals, such as those belonging to Group VI and Group VIII of the Periodic Table. However processes utilizing supported metal catalysts under such high hydrogen partial pressures are expensive to build and operate due to the high operating pressures, expensive metal catalysts, and the high hydrogen content required for the processes.

Other intermediate refinery crude fractions, such as vacuum gas oils, atmospheric resids, vacuum resids, and other similar intermediate feedstreams containing boiling point materials above about 650° F. (343° C.) contain similar sulfur polycyclic heteroatom complexes (which may include asphaltenes) and are also difficult to desulfurize by conventional methods. Refinery streams such as cycle oils and coker gas oils which boil as low as 430° F. (220° C.) often possess high aromatic contents which makes desulfurization difficult by conventional methods. These heavy crudes, derived refinery feedstocks, heavy residual intermediate hydrocarbon streams, and refinery product streams and blends can contain significant amounts of sulfur. Sulfur contents of in excess of 3 to 5 wt % are not uncommon for these streams and can often be concentrated to higher contents in the refinery heavy residual streams. Additionally, most conventional catalytic refining and petrochemical processes cannot be used on these heavy feedstreams and intermediates due to their use of fixed bed catalyst systems and the tendency of these heavy hydrocarbons to produce excessive coking and deactivation of the catalyst systems when in contact with such feedstreams. Also, due to the excessive hydrocarbon unsaturation and cracking of carbon-to-carbon bonds experienced in these processes, significant amounts of hydrogen are required to treat high aromatic and asphaltene containing feeds. The high consumption of hydrogen, which is a very costly treating agent, in these processes results in significant costs associated with the conventional catalytic hydrotreating of heavy hydrocarbon feedstreams for sulfur removal.

Additionally, some crudes, synthetic crudes, rough crude distillation cuts, and bitumens cannot be readily transported over existing pipeline systems due to their high sulfur content, high viscosities, and low API gravities. As a result these heavy hydrocarbon supply streams are often severely discounted for use as a feedstock for producing higher value products. Another alternative utilized in the art to make these heavy hydrocarbon supply streams suitable for pipeline transportation or petrochemical feed is to dilute these streams with expensive, lower sulfur hydrocarbon diluents.

In light of the drawbacks of conventional hydrodesulfurization over Group VI and Group VIII supported catalysts, desulfurization of heavy oils utilizing alkali metal compounds (e.g., potassium hydroxide and sodium hydroxide) is an economically attractive process for desulfurization of heavy oils. Such processes are described in U.S. Pat. No. 1,938,672 and U.S. Pat. No. 2,950,245 wherein alkali metals, in particular sodium and potassium, and preferably their oxide and hydroxide forms, are used in processes for the desulfurization and demetallization of hydrocarbon streams. Processes such as described in U.S. Pat. No. 4,127,470 disclose processes for desulfurizing hydrocarbon streams utilizing via alkali metal hydroxides (potassium hydroxide) in the presence of hydrogen to improve the product qualities of the product hydrocarbon stream.

However, a major problem faced in the industry is that alkali metal hydrosulfides (e.g., KSH) are formed as a reaction product during the process of desulfurizing the hydrocarbon stream. In order to reuse the spent alkali metals in the desulfurization process, these alkali metal hydrosulfides need to be regenerated into the alkali metal hydroxide form. Without an economical method in which to regenerate the spent hydroxides, the cost efficiency of the overall alkali metal treatment processes are significantly economically hampered. That is, that if the alkali metal hydroxides cannot be regenerated from the spent hydrosulfides, the cost for continually supplying fresh alkali metal hydroxides as well as the additional disposal requirements for the spent alkali metal compounds can often mean the difference between an economically viable process and a process which cannot make sufficient profits to justify its installation or continued operation. Additionally, significant environmental benefits are also realized if the alkali metal hydroxides can be regenerated and reused in the desulfurization processes.

Therefore, there exists in the industry a need for an improved process for desulfurizing hydrocarbon streams as well as regenerating alkali metal hydrosulfides into alkali metal hydroxides which can be reutilized in the desulfurization process for hydrocarbon upgrading.

SUMMARY OF THE INVENTION

The current invention embodies processes for desulfurizing a sulfur-containing hydrocarbon feedstream to produce a product stream with a reduced sulfur content utilizing an alkali metal hydroxide reagent and then converting the spent reagent (in particular the alkali metal hydrosulfides) back to their alkali metal hydroxide forms via reaction with a transition metal oxide, most preferably copper oxide. In preferred embodiments, the transition metal (e.g., copper) oxide catalyst may be mixed with an aqueous solution of the spent alkali metal hydrosulfide that is a by-product of alkali metal hydroxides utilized in the desulfurization of a sulfur containing hydrocarbon feedstream. Alternatively, the transition metal oxide may be incorporated onto an amorphous support and utilized in a fixed bed reactor for the regeneration of the spent alkali metal hydrosulfides into alkali metal hydroxides which can be used in the hydrocarbon desulfurization process. When in this fixed bed configuration, the supported transition metal oxide catalyst can be regenerated in place utilizing a heated oxygen source.

A preferred embodiment of the present invention is a process for desulfurizing a sulfur-containing hydrocarbon stream, comprising:

a) contacting a sulfur-containing hydrocarbon stream with an API gravity less than about 40 with an alkali metal hydroxide in a first reaction zone, thereby producing a desulfurized hydrocarbon/spent alkali metal reagent stream;

b) conducting the desulfurized hydrocarbon/spent alkali metal reagent stream to a first separation zone, wherein at least a portion of the desulfurized hydrocarbons are separated from the spent alkali metal reagents, thereby producing a desulfurized hydrocarbon product stream;

c) conducting at least a portion of the spent alkali metal reagents to a second reaction zone, wherein the spent alkali metal reagents are contacted with a transition metal oxide selected from copper oxide, zinc oxide, cobalt oxide, nickel oxide and iron oxide, and wherein the spent alkali metal reagents are comprised of alkali metal hydrosulfides, and at least a portion of the alkali metal hydrosulfides are converted to alkali metal hydroxides and at least a portion of the transition metal oxides are converted to transition metal sulfides, thereby producing a desulfurized alkali metal stream comprised of alkali metal hydroxides and transition metal sulfides;

d) conducting at least a portion of the desulfurized alkali metal stream to a second separation zone, wherein at least a portion of the transition metal sulfides are separated from the alkali metal hydroxides;

e) conducting at least a portion of the separated alkali metal hydroxides to the first reaction zone as a regenerated alkali metal hydroxide stream;

f) conducting at least a portion of the separated transition metal sulfides to a first regeneration zone, wherein the separated transition metal sulfides are contacted with an oxygen-containing stream at a temperature from about 1000 to about 2000° F., thereby converting at least a portion of the separated transition metal sulfides to separated transition metal oxides; and g) conducting at least a portion of the separated transition metal oxides to the second reaction zone.

In a more preferred embodiment of the present invention, the sulfur-containing hydrocarbon stream to be desulfurized is a heavy hydrocarbon stream which has an API gravity of less than about 20 and a sulfur content of at least 1 wt %. In yet another preferred embodiment the transition metal oxide utilized in the process is comprised of copper oxide.

Another preferred embodiment of the present invention is a process for desulfurizing a sulfur-containing hydrocarbon stream, comprising:

a) contacting a sulfur-containing hydrocarbon stream with an API gravity less than about 40 with an alkali metal hydroxide in a first reaction zone, thereby producing a desulfurized hydrocarbon/spent alkali metal reagent stream;

b) conducting the desulfurized hydrocarbon/spent alkali metal reagent stream to a first separation zone, wherein at least a portion of the desulfurized hydrocarbons are separated from the spent alkali metal reagents, thereby producing a desulfurized hydrocarbon product stream;

c) conducting at least a portion of the spent alkali metal reagents to a second reaction zone comprising at least two reactors, wherein the spent alkali metal reagents are contacted in at least one reactor with a supported transition metal oxide selected from copper oxide, zinc oxide, cobalt oxide, nickel oxide, and iron oxide, and wherein the spent alkali metal reagents are comprised of alkali metal hydrosulfides, and at least a portion of the alkali metal hydrosulfides are converted to alkali metal hydroxides and at least a portion of the supported transition metal oxides are converted to supported transition metal sulfides, thereby producing a regenerated alkali metal hydroxide stream comprised of regenerated alkali metal hydroxides; and d) conducting at least a portion of the regenerated alkali metal hydroxide stream to the first reaction zone;

wherein periodically the flow of spent alkali metal reagents to at least one of the reactors in the second reaction zone is suspended while at least a portion of the supported transition metal sulfides in the reactor are converted to supported transition metal oxides by contacting the supported transition metal sulfides with an oxygen-containing stream at a temperature from about 1000 to about 2000° F.

DETAILED DESCRIPTION OF THE INVENTION

Figure 1:
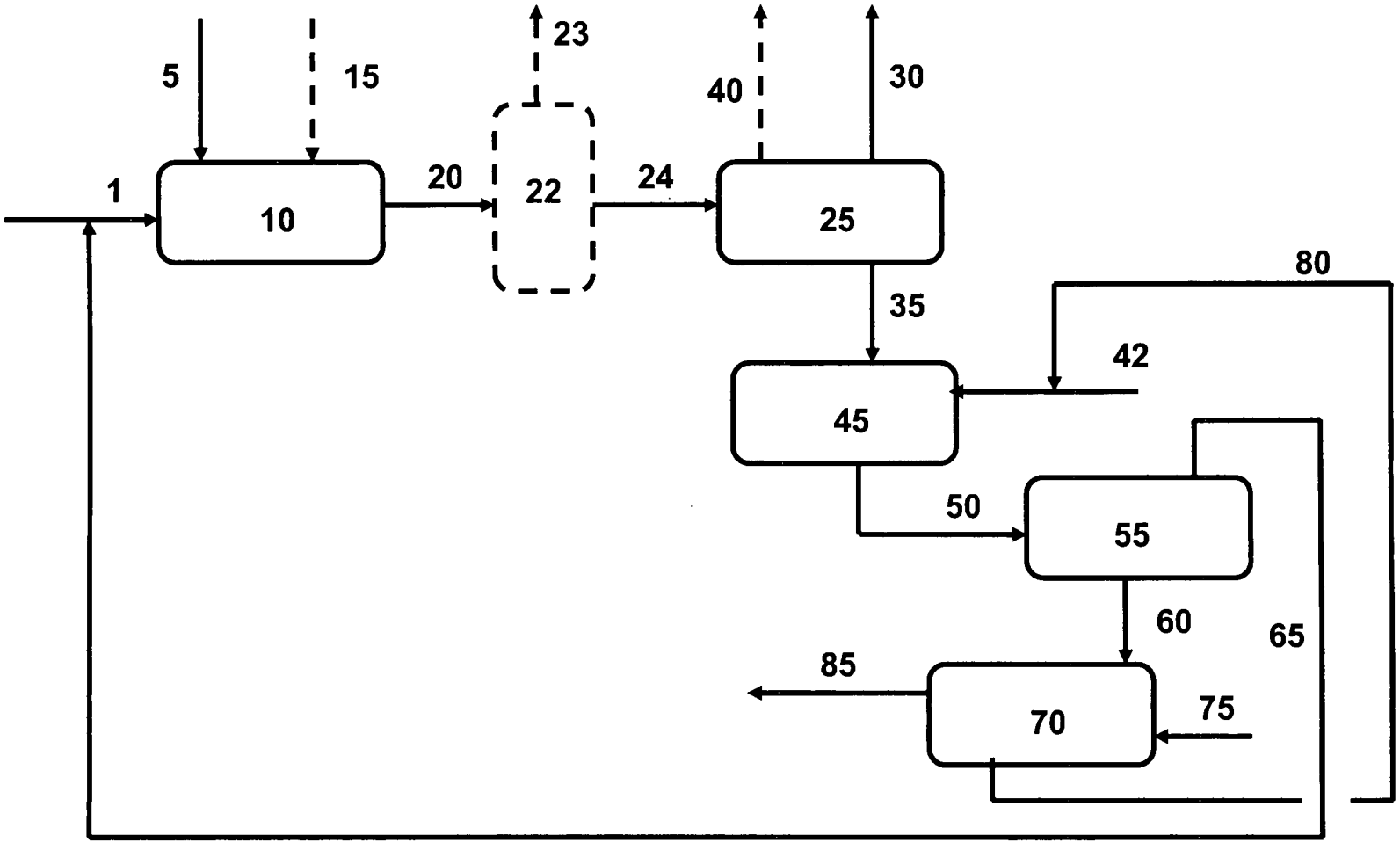
FIG. 1 illustrates one embodiment of the present invention wherein a sulfur-containing hydrocarbon feedstream is desulfurized utilizing an alkali metal hydroxide wherein alkali metal hydrosulfides are formed in the desulfurization process and the resulting alkali metal hydrosulfides are regenerated into alkali metal hydroxides and reutilized in the process by utilizing an unsupported transition metal oxide reagent. In the present process, the unsupported transition metal oxide reagents are also regenerated and re-utilized in the alkali metal regeneration process.

The current invention is a process for desulfurizing a sulfur-containing hydrocarbon feedstream to produce a product stream with a reduced sulfur content utilizing an alkali metal hydroxide reagent and then converting the spent reagent (in particular the alkali metal hydrosulfides) back to their alkali metal hydroxide forms via reaction with a transition metal oxide, most preferably copper oxide.

Alkali metal hydroxides (such as potassium hydroxide, rubidium hydroxide, and cesium hydroxide) can be used in processes for the desulfurization and demetallization of hydrocarbon streams. These alkali metal hydroxides are particularly useful in the desulfurization and demetallization of a heavy hydrocarbon feedstream wherein a significant portion of asphaltenes may be present in the heavy oil stream. These hydrocarbon streams to be treated contain sulfur, much of which is part of the polar fraction and higher molecular weight aromatic and polycyclic heteroatom-containing compounds, herein generally referred to as "aphaltenes" or they are associated in the emulsion phase of such asphaltene species. It should be noted here that the terms "hydrocarbon-containing stream", "hydrocarbon stream" or "hydrocarbon feedstream" as used herein are equivalent and are defined as any stream containing at least 75 wt % hydrocarbons where at least a portion of the hydrocarbons boil above 430° F. (220° C.) and have an API gravity less than 40. These hydrocarbon streams include but are not limited to whole and reduced petroleum crudes, shale oils, coal liquids, atmospheric and vacuum residua, asphaltenes, deasphalted oils, cycle oils, FCC tower bottoms, gas oils, including atmospheric and vacuum gas oils and coker gas oils, fuel oils, light to heavy distillates including raw virgin distillates, hydrocrackates, hydrotreated oils, dewaxed oils, slack waxes, raffinates, and mixtures thereof.

Also, the terms "heavy hydrocarbon" or "heavy hydrocarbon stream" are equivalent and are defined herein as hydrocarbon streams having an API gravity of less than 20. Preferred heavy hydrocarbon streams for use in the present invention include, but are not limited to low API gravity, high sulfur, high viscosity crudes; tar sands bitumen; liquid hydrocarbon streams derived from tar sands bitumen, coal, or oil shale; as well as petrochemical refinery heavy intermediate fractions, such as atmospheric resids, vacuum resids, and other similar intermediate feedstreams and mixtures thereof containing boiling point materials above about 650° F. (343° C.). Heavy hydrocarbon streams may also include a blend of the hydrocarbons listed above with lighter hydrocarbon streams for control of certain properties for transport or sale, such as, but not limited to fuel oils and crude blends.

In preferred embodiments of the present invention, the hydrocarbon stream and/or the heavy hydrocarbon stream that is desulfurized in the present process contains at least 1 wt % sulfur and more preferably at least 3 wt % sulfur. In other preferred embodiments of the present invention, the hydrocarbon stream and/or the heavy hydrocarbon stream that is desulfurized in the present process contains polycyclic sulfur heteroatom complexes which are difficult to desulfurize by conventional methods.

FIG. 1 illustrates a preferred embodiment of the present invention. In FIG. 1, a hydrocarbon stream (1), preferably a heavy hydrocarbon stream, containing sulfur enters a first reaction zone (10) wherein it is contacted with an alkali metal hydroxide (5). In the present process it is important that the hydrocarbon stream (1) and alkali metal hydroxide (5) are properly mixed to provide good contact between the two streams. The alkali metal hydroxide as utilized in the present invention is preferably selected from the hydroxides of potassium, rubidium, cesium, or combinations thereof. Additionally, one or more of these hydroxides may be used in combination with the hydroxides of lithium and/or sodium. In a more preferred embodiment of the present invention, the alkali metal hydroxide is potassium hydroxide, KOH.

Static, rotary, or other types of mixing devices can be employed in the feed lines and/or in the reaction zone to improve the hydrocarbon/alkali metal hydroxide contact. A hydrogen-containing stream (15) can optionally be introduced into the first reaction zone to improve the overall desulfurization process. It is preferred that the hydrogen-containing stream contain at least 50 mol %, more preferably at least 75 mol % hydrogen. When hydrogen is utilized in the process, it is preferred that the hydrogen partial pressure be from about 100 to about 2500 psi. At these partial pressures, the hydrogen assists in the reaction process by removing at least a portion of the sulfur in the hydrocarbons via conversion to the alkali metal hydrosulfide, which may, but is not required to, go through a hydrogen sulfide, $H_2S$ intermediate. Hydrogen sulfide that is formed in the first reaction zone can also react with the alkali metal hydroxides donating some of the sulfur and forming alkali metal hydrosulfides and alkali metal sulfides thereby improving the overall sulfur removal in the process. Excess hydrogen also assists in hydrogenating the broken sulfur bonds in the hydrocarbons and increasing the hydrogen saturation of the resulting desulfurized hydrocarbon compounds.

Herein, the first reaction zone (10) can be comprised of a vessel or even simply piping which provides sufficient time and conditions for the hydrocarbon stream and the alkali metal hydroxide to contact sufficiently to allow for the hydrocarbon stream to be desulfurized. By "desulfurized" it is meant herein that at least 50% of the sulfur by weight % (wt %) in the hydrocarbon stream is removed in the process. Preferred conditions in the first reaction zone are about 650 to about 900° F., preferably about 675 to about 875° F., and more preferably about 700 to about 850° F. and about 50 to about 3000 psi, preferably about 200 to about 2200 psi, and more preferably about 500 to about 1500 psi. Additionally, it is preferred that the contact time of the hydrocarbon stream in the reaction chamber be about 5 to about 720 minutes, preferably about 30 to about 480 minutes, and more preferably 60 to about 240 minutes, although the contact time is highly dependent upon the physical and chemical characteristics of the hydrocarbon stream including the sulfur content and sulfur species of the hydrocarbon stream, the amount of sulfur to be removed, as well as the molar ratio of the alkali metal hydroxide used in the process to the sulfur present in the hydrocarbon stream.

The alkali metal hydroxide is preferably added to the feed or a portion of the feed as a concentrated aqueous solution. Water is flashed off to leave highly dispersed/molten alkali metal hydroxide in the feed which may be combined with hydrogen and sent to the reactor. If the alkali hydroxide is added to a portion of the feed, it is recombined with the main feed stream prior to the reactor and/or at various stages in the reactor. If hydrogen is used, hydrogen can also be added at various stages in the reactor. The amount of alkali metal hydroxide added to the feed is about 0.75 to about 5.0 moles per mole of feed sulfur, preferably about 1.0 to about 3.0 moles per mole of feed sulfur, and more preferably about 1.0 to about 2.0 moles per mole of feed sulfur.

In the desulfurization reaction process, the hydroxide (e.g., potassium hydroxide, KOH) removes at least a portion of the sulfur from the hydrocarbon stream and is converted to the alkali metal hydrosulfide form (e.g., potassium hydrosulfide, KSH) by the following equation:

$$KOH+RSR+2H_2 \rightarrow KSH+2RH+H_2O \quad [1]$$

Where R represents varied feed hydrocarbon moieties. If $H_2$ is not present, the hydrogen can be abstracted from sources in the feed, e.g. naphthenes or carbon-carbon bond condensation products can form.

Some of the alkali metal hydroxide is also converted to the alkali metal sulfide (e.g., potassium sulfide, $K_2S$) by the following equation:

$$KOH+KSH \rightarrow K_2S+H_2O \quad [2]$$

Some of the alkali metal sulfide present in the alkali metal hydrosulfide stream will also be regenerated back to the alkali metal hydroxide in the presence of the transition metal oxide. The alkali metal sulfide is still a reasonably active reagent for removing sulfur from the hydrocarbon stream if present.

Continuing with the present process shown in FIG. 1, a desulfurized hydrocarbon/spent alkali metal reagent stream (20) is removed from the first reaction zone (10). The desulfurized hydrocarbon/spent alkali metal reagent stream (20) is preferably sent to a low pressure separator (22) wherein at least a portion of the of the hydrogen, light hydrocarbons, and non-condensable components of the desulfurized hydrocarbon/spent alkali metal reagent stream can be removed via line (23). This pressure-separated reaction stream (24) containing desulfurized hydrocarbons and spent alkali metal compounds are then sent to a first separation zone (25) wherein the desulfurized hydrocarbons and spent alkali metal compounds are separated by various methods known in the art, e.g., a water wash. The spent alkali metal compounds tend to be more soluble in the water-based phase than the desulfurized hydrocarbon. As such, preferred methods of separation include gravitational (or density based) separations processes known in the art such as, but not limited to, the use of settling vessels or centrifuges. In these processes, it is generally advantageous to keep the temperatures in the range of from 50 about 300° F. in order to improve the contacting of the hydrocarbon with the water phase. A desulfurized hydrocarbon product stream (30) is thus obtained from the separator and an aqueous spent alkali metal product stream (35) is also obtained. Filtering can also be utilized to remove some of the solids compounds formed, such as, but not limited to, coke, as well as iron, vanadium, and nickel compounds derived from the feed. In a preferred embodiment of the process of the present invention, most of the hydrogen, light hydrocarbons and non-condensable components in the products from the reaction zone (10) are removed via a low pressure separator (22). However, in conjunction with, or alternative to a low pressure separator (22) it may be desired to remove some of the spent hydrogen stream (40) which may also contain light hydrocarbon products and non-condensable components from the first separation zone (25).

During the course of the present hydrocarbon upgrading process the alkali metal hydroxide reacts with the sulfur compounds in the hydrocarbon stream to form alkali metal sulfides and alkali metal hydrosulfides. The latter is largely passive for the purposes of heavy feed upgrading leading to greatly diminished levels of desulfurization and conversion and driving coke yields in the process to elevated values. For this reason it is essential for an integrated upgrading process utilizing alkali metal salts that a facile and economic means be available for the regeneration of alkali metal hydrosulfide to either an alkali metal hydroxide, an alkali metal sulfide, or to a blend of these latter two alkali metal compounds for recycle to the first reaction zone (10).

As discussed above, after the desulfurization reaction, a stream containing the spent alkali metal compounds (35) is extracted from the desulfurized hydrocarbon product stream (30). In the present invention, the spent alkali metal compounds are regenerated to the alkali metal hydroxide via reaction with a transition metal oxide selected from copper, zinc, cobalt, nickel, and iron. Most preferably is the use of copper oxide and as such, the present invention will be discussed in terms of a copper oxide, although it is disclosed that the use of zinc, cobalt, nickel, or iron oxides can also be used in the process of the present invention. The copper oxide can be either in the form of copper(I) oxide (i.e., $Cu_2O$), or copper (II) oxide (i.e., CuO).

Continuing with FIG. 1, copper oxide (42) is added to the aqueous spent alkali metal product stream (35) in a second reaction zone (45). Preferred operating conditions for the second reaction zone are about 15 to about 500 psi and preferably 50 to 300 psi and about 50 to about 500° F., preferably about 70 to about 400° F., and more preferably about 100 to 350° F. It is desired to maintain good contact between the copper oxide and the aqueous alkali metal product stream to maximize the sulfur transfer from the sulfided alkali metal to the copper oxide. As such, proper mixing of the combined streams in the second reaction zone is recommended. Preferred residence times in the second reaction zones are about 1 to about 240 minutes, preferably about 2 to about 180 minutes, and more preferably 5 to 120 minutes, but generally, the reaction time required is generally very fast and preferably the sulfur exchange reactions take place in the reaction zone in less than about 60 minutes.

In the second reaction zone, a hydrolysis reaction is conducted in an aqueous slurry containing the copper oxide and the aqueous alkali metal product stream. The alkali metal hydrosulfides are converted to their hydroxide forms in the second reaction zone. The chemical reactionary processes are as follows illustrated for the regeneration of potassium salts utilizing copper(I) oxide ($Cu_2O$) or copper(II) oxide (CuO):

$$Cu_2O + KSH \xrightarrow{H_2O} Cu_2S + KOH \quad [3]$$

$$CuO + KSH \xrightarrow{H_2O} CuS + KOH \quad [4]$$

A regenerated alkali metal hydroxide stream (50) comprised of copper sulfide and the regenerated alkali metal hydroxide is withdrawn from the second reaction zone (45). The copper sulfide is then separated from the alkali metal hydroxide in a second separation zone (55). Although numerous separations processes known in the art may be used to separate the copper sulfide from the alkali metal hydroxide, in one preferred embodiment of the present invention, the second separation zone (55) provides sufficient residence time to allow for a gravity or density based separation of the copper sulfides, which are less soluble in water than the alkali metal hydroxides. In this embodiment, the copper sulfides are allowed to gravity settle from the aqueous solution and the copper sulfide (60) can be extracted from the second separation zone (55). The copper sulfide may be in solution or can be filtered and removed as a solid. In a second preferred embodiment of the present invention, the second separation zone (55) utilizes filtration techniques known in the art to separate the copper sulfide solids from the aqueous alkali metal hydroxides. In both of these preferred processes, it is generally advantageous to keep the temperature in the second separation zone (55) in the range of from 50 to about 300° F.

A regenerated aqueous alkali metal hydroxide stream (65) is extracted from the second separation zone (55) and is returned for use in the first reaction zone (10). Optionally, although not shown in the figure, the regenerated alkali metal hydroxide stream can further be dehydrated and/or filtered in order to transport and/or supply the regenerated alkali metal salts in solid form prior to reuse in the first reaction zone (10).

The separated copper sulfide (60) is sent to a first regeneration zone (70) where it is contacted with air (or another oxygen-containing source) (75) under sufficient temperatures and durations to regenerate the copper sulfide back into copper oxide as follows:

$$CuS \xrightarrow{\text{Air (oxygen)}} CuO + SO_2 \quad [5]$$

$$Cu_2S \xrightarrow{\text{Air (oxygen)}} 2\,CuO + SO_2 \quad [6]$$

In a preferred embodiment, CuS is first heated in the absence of air (or another oxygen-containing source) to release sulfur and form $Cu_2S$ as follows:

$$2CuS \rightarrow Cu_2S + \tfrac{1}{8}S_8 \quad [7]$$

and the $Cu_2S$ is then reacted with air (or another oxygen-containing source) according to [6].

In preferred embodiments of the present invention, the copper sulfide is contacted with air (or another oxygen source) at temperatures of about 1000 to about 2000° F., preferably 1200 to 1900° F., and more preferably 1500 to 1800° F. in the first regeneration zone (70). If the CuS is thermally converted to $Cu_2S$ prior to roasting with air or another oxygen source, that reaction is conducted at about 500 to about 1500° F., preferably about 700 to about 1300° F., and more preferably about 800 to about 1200° F. The regenerated copper oxide (80) can then be returned for reuse in the second reaction zone (45). A stream comprising sulfur dioxide (85) is also removed from the first regeneration zone (70). This sulfur dioxide-containing stream (85) may be sent to a Claus plant, converted into sulfur through other methods known in the art, used for enhanced oil recovery, or converted into sulfuric acid. Sulfur generated by the thermal decomposition of CuS to $Cu_2S$ can be collected and disposed of by conventional methods.

The inventors have discovered that the desulfurization process with alkali metal hydroxides generates alkali metal carbonate byproducts. A basis for a possible mechanism of carbonate formation is that the hydroxide moiety attached to a styrene group generated after the desulfurization of benzothiophene isomerizes to an aldehyde which eliminates as carbon monoxide. An alternative proposal is further attack of the aldehyde by hydroxide ions with eventual formation of alkali metal carbonates. Like the alkali metal hydrosulfides, the carbonates are inactive for desulfurization, but the carbonates are not removed by the transition metal oxide treatment, and will eventually build up in solution.

Although this alternate embodiment is not shown in the figures, the alkali metal carbonates can be converted into alkali metal hydroxides by treatment with an aqueous suspension of calcium oxide and calcium hydroxide to form calcium carbonate and aqueous alkali metal hydroxide. This media will also remove any sulfate contaminants in the stream as calcium sulfate (gypsum). The calcium carbonate generated can be calcined back to calcium oxide and reused or landfilled. This calcium oxide/calcium hydroxide treatment is conducted at reaction temperatures of about 50 to about 400° F., and preferably about 70 to about 350° F. Calcium carbonate decomposition to calcium oxide is carried out at about 1500 to about 2000° F. and preferably at about 1700 to about 1900° F. The calcium oxide/calcium hydroxide treatment may be carried out on either the aqueous spent alkali metal product stream (35) prior to the transition metal oxide treatment of the second reaction zone (45) or more preferably the calcium oxide/calcium hydroxide treatment is performed on the regenerated aqueous alkali metal hydroxide stream (65) prior to reuse in the first reaction zone (10).

Figure 2:
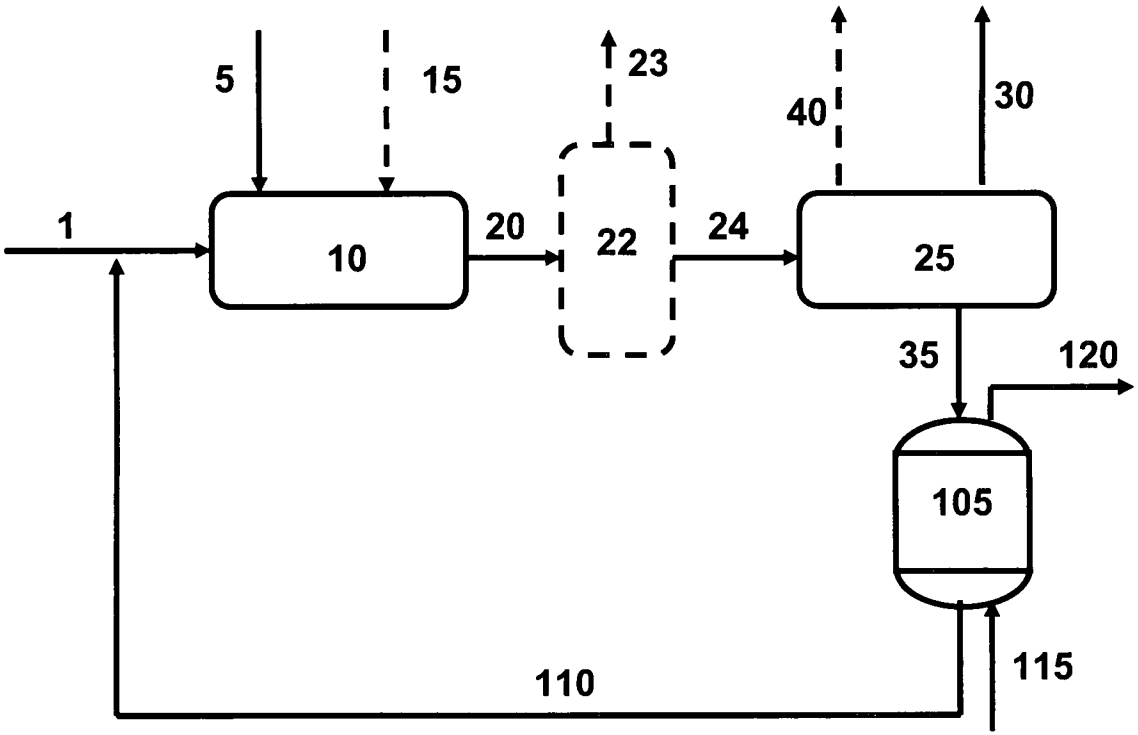
FIG. 2 illustrates one embodiment of the present invention wherein a sulfur-containing hydrocarbon feedstream is desulfurized utilizing an alkali metal hydroxide wherein alkali metal hydrosulfides are formed in the desulfurization process and the resulting alkali metal hydrosulfides are regenerated into alkali metal hydroxides and reutilized in the process by utilizing a supported transition metal oxide reagent. In the present process, the unsupported transition metal oxide reagents are also regenerated and re-utilized in the alkali metal regeneration process.

Another preferred embodiment of the present invention is illustrated in FIG. 2. In this process, the desulfurization steps (1) through (40) are the same as described in FIG. 1, and therefore are not reiterated here for the description of FIG. 2. However, in this embodiment, the copper oxide used in the process is supported on an amorphous support and is utilized as a fixed reagent in the second reaction zone (105). In this embodiment, the amorphous support may be selected from alumina, silica, zirconia, or a mixture thereof. Continuing with FIG. 2, the aqueous alkali metal product stream (35) from the first separation zone (25) enters the second reaction zone (105) wherein it contacts the supported copper oxide catalyst. In preferred embodiments, the pressure in the second reaction zone is from about 15 to about 300 psi and preferably 50 to 200 and the temperature of the reaction zone is from about 50 to about 400° F., preferably about 70 to about 400° F., and more preferably about 100 to about 350° F. In this embodiment, the chemical processes in the second reaction zone are similar to those of the embodiment shown in FIG. 1, wherein the alkali metal hydrosulfides are converted to their hydroxide forms. The chemical processes involved in the regeneration of the spent alkali metal hydrosulfides are similar to as described prior in the embodiment of FIG. 1 and as illustrated for potassium salt regeneration in Equations 1 and 2.

Continuing with FIG. 2, the copper oxide of the supported catalyst is converted to copper sulfide as sulfur is extracted from the spent alkali metal salts (35) in the second reaction zone (105). A resulting regenerated aqueous alkali metal hydroxide stream (110) is withdrawn from the second reaction zone and is returned for reutilization as a desulfurization agent in the first reaction zone (10). Optionally, the regenerated aqueous alkali metal hydroxide stream can further be dehydrated and/or filtered in order to transport and/or supply the regenerated alkali metal salts in solid form prior to reuse in the first reaction zone (10).

In this embodiment shown in FIG. 2, when the supported copper catalyst is spent, the flow of the aqueous alkali metal product stream (35) is stopped so that the supported copper catalyst can be regenerated. Although not shown in FIG. 2, the preferred embodiment of the present invention is to utilize at least two reactors in the second reaction zone and "swing" the flow of the aqueous alkali metal product stream from one reactor to the other reactor, so there is uninterrupted flow of the process. When the flow is removed from one of the reactors (i.e., the idle reactor), the supported copper catalyst in the idle reactor can be regenerated while the second reactor continues treating the aqueous alkali metal product stream. The spent supported copper catalyst in second reaction zone (105) is regenerated by flowing heated air (or other oxygen-containing source) (115) through the second reaction zone (105). Although the flow of the heated air (or other oxygen-containing source) (115) in FIG. 2 is shown opposite of the normal process flow, the flow of heated air may be co-current with the direction of normal flow or other otherwise arranged. The temperature of the second reaction zone during the catalyst regeneration step is preferably from about 1000 to about 2000° F., more preferably from about 1200 to about 1900° F., and even more preferably from about 1500 to about 1800° F., and of sufficient time to drive the reaction as shown in Equation 2 above to convert the copper sulfide species in the supported catalyst back to copper oxide. A stream comprising sulfur dioxide (120) is also removed from the second reaction zone (105). The sulfur dioxide is disposed of in the same manner as in the bulk transition metal oxide treatment.

Similar to the alternate embodiment described for the prior embodiment of FIG. 1, the alkali metal carbonates formed during the process embodiment described for FIG. 2 can be treated with an aqueous suspension of calcium oxide and calcium hydroxide to form calcium carbonate and aqueous alkali metal hydroxide. The calcium oxide/calcium hydroxide treatment may be carried out under the conditions described prior on either the aqueous spent alkali metal product stream (35) prior to the transition metal oxide treatment of the second reaction zone (105), or more preferably, the calcium oxide/calcium hydroxide treatment is performed on the regenerated alkali metal hydroxide stream (110) prior to reuse in the first reaction zone (10).

Although the present invention has been described in terms of specific embodiments, it is not so limited. Suitable alterations and modifications for operation under specific conditions will be apparent to those skilled in the art. It is therefore intended that the following claims be interpreted as covering all such alterations and modifications as fall within the true spirit and scope of the invention.

EXAMPLES

Example 1

Reaction of Copper(I) Oxide with Aqueous Potassium Hydrosulfide to Form Copper(I) Sulfide In this example, 2.88 g of $Cu_2O$ and 1.45 g of KSH were combined under nitrogen in a round bottom flask with 10 mL of deionized water. Samples were stirred at room temperature for 1 hr, refluxed for 1 hr, or refluxed 8 hrs. When refluxing was utilized, the evaporated liquids were condensed at temperatures of about 100° C. and returned to the reaction flask. As seen in Table 1 all three samples reacted to form solid $Cu_2S$ leaving KOH in solution. The formation of $Cu_2S$ was confirmed with XRD. Sulfur was reduced to <1 ppm in solution and minimal Cu entered the solution.

TABLE 1

| Conditions | wt. $Cu_2S$ (g) | % Theoretical $Cu_2S$ | S in solution (ppm) | Cu in solution (ppm) |
|---|---|---|---|---|
| R.T., 1 hr | 3.23 | 100.9 | <1 | <1 |
| Reflux, 1 hr | 3.09 | 96.6 | <1 | <1 |
| Reflux, 6 hrs | 3.18 | 99.4 | <1 | 3 |

The proposed reaction pathway is as shown in Equation 1 of the present specification. This shows that nearly 100% of the sulfur was removed from the KSH resulting in nearly full conversion of the KSH to KOH.

Example 2

Reaction of Copper(II) Oxide with Aqueous Potassium Hydrosulfide to Form Copper(II) Sulfide In this example, 1.60 g of CuO and 1.45 g of KSH were combined under nitrogen in a round bottom flask with 10 mL of deionized water. Samples were stirred at room temperature for 1 hr, refluxed for 1 hr, or refluxed 8 hrs. As seen in Table 2 all three samples reacted to form solid CuS leaving KOH in solution. The formation of CuS was confirmed with XRD. Sulfur was reduced to <1 ppm in solution and minimal Cu entered the solution.

TABLE 2

| Conditions | wt. CuS (g) | % Theoretical CuS | S in solution (ppm) | Cu in solution (ppm) |
|---|---|---|---|---|
| R.T., 1 hr | 1.89 | 98.4 | <1 | <1 |
| Reflux, 1 hr | 1.84 | 95.8 | <1 | <1 |
| Reflux, 6 hrs | 1.88 | 97.9 | <1 | <1 |

The proposed reaction pathway is as shown in Equation 2 of the present specification. This shows that over 95% of the sulfur was removed from the KSH resulting in nearly full conversion of the KSH to KOH.

Example 3

Oxidative Conversion of Copper(II) Sulfide to Copper(II) Oxide

In this example, a sample of CuS was heated up to 900° C. in air. At 375° C. the sample had lost 16.3% of the initial weight. The sample then began to gain weight, probably sulfate formation, reaching at 700° C. about 1.3% more than the starting sample weight, followed by a rapid weight loss. At 900° C. the product weight was 18.2% less than the initial weight, which corresponds to the formation of CuO. An XRD of a sample heated up to 900° C. in air confirmed that the sample was predominately CuO.

The proposed reaction pathway is as shown in Equation 3 of the present specification. This example shows that almost all of the CuS was converted to CuO by the present process.

Example 4

Oxidative Conversion of Copper(I) Sulfide to Copper(II) Oxide

In this example, a sample of $Cu_2S$ was heated up to 900° C. in air. At 300° C. the sample began to gain weight, probably sulfate formation, which about 650° C. peaked at 35.3% greater than the initial sample weight. Rapid weight loss followed and at 900° C., the sample had essentially the same weight as at the beginning, which corresponds to the formation of CuO from $Cu_2S$. An XRD of a sample heated up to 900° C. in air confirmed that the sample was predominately CuO.

The proposed reaction pathway is as shown in Equation 4 of the present specification. This example shows that almost all of the $Cu_2S$ was converted to CuO by the present process.

Example 5

Thermal Decomposition of Copper(II) Sulfide to Copper(I) Sulfide

In this example, a sample of CuS was heated up to 450° C. under nitrogen. A weight loss of 18% corresponded to the formation of $Cu_2S$ from CuS An XRD of a sample heated to 450° C. under nitrogen confirmed that the sample was predominately $Cu_2S$.

The proposed reaction pathway is as shown in Equation 5 of the present specification. This example shows that almost all the CuS was converted to $Cu_2S$ by the present process.

What is claimed is:

1. A process for desulfurizing a sulfur-containing hydrocarbon stream, comprising:

a) contacting a sulfur-containing hydrocarbon stream with an API gravity less than about 40 with an alkali metal hydroxide in a first reaction zone, thereby producing a desulfurized hydrocarbon/spent alkali metal reagent stream;

b) conducting the desulfurized hydrocarbon/spent alkali metal reagent stream to a first separation zone, wherein at least a portion of the desulfurized hydrocarbons are separated from the spent alkali metal reagents, thereby producing a desulfurized hydrocarbon product stream;

c) conducting at least a portion of the spent alkali metal reagents to a second reaction zone, wherein the spent alkali metal reagents are contacted with a transition metal oxide selected from copper oxide, zinc oxide, cobalt oxide, nickel oxide and iron oxide, and wherein the spent alkali metal reagents are comprised of alkali metal hydrosulfides, and at least a portion of the alkali metal hydrosulfides are converted to alkali metal hydroxides and at least a portion of the transition metal oxides are converted to transition metal sulfides, thereby producing a desulfurized alkali metal stream comprised of alkali metal hydroxides and transition metal sulfides;

d) conducting at least a portion of the desulfurized alkali metal stream to a second separation zone, wherein at least a portion of the transition metal sulfides are separated from the alkali metal hydroxides;

e) conducting at least a portion of the separated alkali metal hydroxides to the first reaction zone as a regenerated alkali metal hydroxide stream;

f) conducting at least a portion of the separated transition metal sulfides to a first regeneration zone, wherein the separated transition metal sulfides are contacted with an oxygen-containing stream at a temperature from about 1000 to about 2000° F., thereby converting at least a portion of the separated transition metal sulfides to separated transition metal oxides; and g) conducting at least a portion of the separated transition metal oxides to the second reaction zone;

wherein the separated transition metal sulfides are comprised of copper(II) sulfides and are first heated under inert atmosphere to decompose any copper(II) sulfides to copper(I) sulfides and sulfur, before contacting with an oxygen-containing stream.

2. The process of claim 1, wherein the desulfurized hydrocarbon product stream has a sulfur content by weight % that is less than 50% of the sulfur content by weight % of the sulfur-containing heavy hydrocarbon stream.

3. The process of claim 1, wherein the sulfur-containing hydrocarbon stream is a heavy hydrocarbon stream which has an API gravity of less than about 20 and a sulfur content of at least 1 wt %.

4. The process of claim 1, wherein the transition metal oxide is comprised of copper oxide.

5. The process of claim 4, wherein the copper oxide is selected from copper(I) oxide and copper(II) oxide.

6. The process of claim 1, wherein the alkali metal hydroxide is selected from potassium hydroxide, rubidium hydroxide, cesium hydroxide, and mixtures thereof.

7. The process of claim 1, wherein the reaction conditions in the first reaction zone are from about 50 to about 3000 psi, and from about 600 to about 900° F.

8. The process of claim 1, wherein the reaction conditions in the second reaction zone are about 15 to about 500 psi, and about 50 to about 500° F.

9. The process of claim 1, wherein a hydrogen-containing stream comprising at least 50 mol % hydrogen is conducted to the first reaction zone.

10. The process of claim 1, wherein the regenerated alkali metal hydroxide stream contains carbonates and at least a portion of the regenerated alkali metal hydroxide stream is subjected to a carbonate removal step prior to returning the regenerated alkali metal hydroxide stream to the first reaction zone.

11. The process of claim 10, wherein the carbonate removal step is comprised of contacting the regenerated alkali metal hydroxide stream with an aqueous suspension of calcium oxide and calcium hydroxide.

12. A process for desulfurizing a sulfur-containing hydrocarbon stream, comprising:

a) contacting a sulfur-containing hydrocarbon stream with an API gravity less than about 40 with an alkali metal hydroxide in a first reaction zone, thereby producing a desulfurized hydrocarbon/spent alkali metal reagent stream;

b) conducting the desulfurized hydrocarbon/spent alkali metal reagent stream to a first separation zone, wherein at least a portion of the desulfurized hydrocarbons are separated from the spent alkali metal reagents, thereby producing a desulfurized hydrocarbon product stream;

c) conducting at least a portion of the spent alkali metal reagents to a second reaction zone comprising at least two reactors, wherein the spent alkali metal reagents are contacted in at least one reactor with a supported transition metal oxide selected from copper oxide, zinc oxide, cobalt oxide, nickel oxide, and iron oxide, and wherein the spent alkali metal reagents are comprised of alkali metal hydrosulfides, and at least a portion of the alkali metal hydrosulfides are converted to alkali metal hydroxides and at least a portion of the supported transition metal oxides are converted to supported transition metal sulfides, thereby producing a regenerated alkali metal hydroxide stream comprised of alkali metal hydroxides; and d) conducting at least a portion of the regenerated alkali metal hydroxide stream to the first reaction zone;

wherein periodically the flow of spent alkali metal reagents to at least one of the reactors in the second reaction zone is suspended while at least a portion of the supported transition metal sulfides in the reactor are converted to supported transition metal oxides by contacting the supported transition metal sulfides with an oxygen-containing stream at a regeneration temperature from about 1000 to about 2000° F.;

wherein at least a portion of the supported copper oxides are converted supported copper(II) sulfides and the supported copper sulfides are first heated under inert atmosphere to decompose and copper(II) sulfides to copper(I) sulfides and sulfur, before contacting with an oxygen-containing stream.

13. The process of claim 12, wherein the desulfurized hydrocarbon product stream has a sulfur content by weight % that is less than 50% of the sulfur content by weight % of the sulfur-containing heavy hydrocarbon stream.

14. The process of claim 12, wherein the sulfur-containing hydrocarbon stream is a heavy hydrocarbon stream which has an API gravity of less than about 20 and a sulfur content of at least 1 wt %.

15. The process of claim 12, wherein the supported transition metal oxide is comprised of copper oxide.

16. The process of claim 15, wherein the copper oxide is selected from copper(I) oxide and copper(II) oxide.

17. The process of claim 12, wherein the alkali metal hydroxide is selected from potassium hydroxide, rubidium hydroxide, cesium hydroxide, and mixtures thereof.

18. The process of claim 12, wherein the reaction conditions in the first reaction zone are from about 50 to about 3000 psi, and from about 600 to about 900° F.

19. The process of claim 12, wherein the reaction conditions in the second reaction zone during step c) are about 15 to about 500 psi, and about 50 to about 500° F.

20. The process of claim 12, wherein a hydrogen-containing stream comprising at least 50 mol % hydrogen is conducted to the reaction zone.

21. The process of claim 12, wherein the regenerated alkali metal hydroxide stream contains carbonates and at least a portion of the regenerated alkali metal hydroxide is subjected to a carbonate removal step prior to returning the regenerated alkali metal hydroxide stream to the first reaction zone.

22. The process of claim 21, wherein the carbonate removal step is comprised of contacting the regenerated alkali metal hydroxide stream with an aqueous suspension of calcium oxide and calcium hydroxide.

* * * * *